United States Patent [19]

Neidecker et al.

[11] Patent Number: 4,806,122

[45] Date of Patent: Feb. 21, 1989

[54] ELECTRIC CONTACT ARRANGEMENT FOR A MULTI-STRAND CABLE

[75] Inventors: Rudolf Neidecker, Basel; Jacques Kunz, Schönenbuch, both of Switzerland

[73] Assignee: Multi-Contact AG Basel, Basel, Switzerland

[21] Appl. No.: 11,010

[22] Filed: Feb. 5, 1987

[30] Foreign Application Priority Data

Aug. 9, 1986 [DE] Fed. Rep. of Germany ..... 3627041

[51] Int. Cl.[4] ..... H01R 23/66

[52] U.S. Cl. ..... 439/495; 439/53; 439/174; 174/117 FF

[58] Field of Search ..... 439/166, 174, 42, 148, 439/39, 397, 492, 495, 405, 422, 493, 52, 53; 174/117 F, 117 FF

[56] References Cited

U.S. PATENT DOCUMENTS

| | | | |
|---|---|---|---|
| 3,999,826 | 12/1976 | Yurtin | 439/495 |
| 4,051,383 | 9/1977 | Dola | 439/492 |
| 4,071,289 | 1/1978 | Szudarek | 439/495 |
| 4,143,931 | 3/1979 | Skare et al. | 174/117 FF |

FOREIGN PATENT DOCUMENTS

| | | | |
|---|---|---|---|
| 1330512 | 9/1973 | United Kingdom | 174/117 FF |

*Primary Examiner*—David Pirlot

*Attorney, Agent, or Firm*—Tarolli, Sundheim & Covell

[57] ABSTRACT

An electric contact arrangement for a multi-strand cable having at least one connection position for receiving a contact plug, comprises a plurality of spaced openings extending through the cable insolation and defining the connection position, and a respective plurality of plug contacts received in the openings. Each contact comprises a contact element that in engaged position thereof makes electrical contact with a cable strand intersecting the end zone of a respective opening.

20 Claims, 5 Drawing Sheets

ELECTRIC CONTACT ARRANGEMENT FOR A MULTI-STRAND CABLE

The invention relates to an electric contact arrangement for plurality of elongated conductors designed in particular as a multi-strand cable. Such contact arrangements are widely used, especially with a large number of connecton positions, arranged over the length of the multi-strand cable, and a corresponding number of multi-pole connection plugs, to feed current in parallel to a plurality of devices, especially low current and/or low voltage devices, such as lamps and the like.

A contact arrangement of this kind is known from German Pat. No. 3,019,060 A1. The patent discloses a connection position with one insulated opening arranged between two (lying side-by-side) strands of a flat cable. Two conductors extend at diametrically opposite end zones of the insulated opening forming corresponding contact points. Each connection plug has only one plug contact with two insulated contact elements arranged diametricaly opposite each other in the plug cross-section and extending transverse to the lengthwise extent of the conductor. By rotating the plug engaging the insulated opening around the central axis of the opening extending transverse to the lengthwise direction of the conductors, the two contact elements can be moved, in a common plane, between an "on" position, transverse to the lengthwise extent of the conductors, and an "off" position, parallel with the lengthwise extent of the conductors.

In the known design, reliability of contact engagement needs to be improved, because the two-pole contact plug is secured in its "on" position, essentially, only by friction and therefore does not provide reliable constant contact surfaces. Also, in many cases, an increased dielectric strength is desired between the conductors or cable strands in the zone of the connection positions, which is quite limited, in the known design, because of the relatively small distance between the contact elements of the contact plug, especially, in wet environment.

The object of the invention, therefore, is to provide a contact arrangement which distinguishes from the known arrangement by increased contact engagement reliability as well as by increased dielectric strength, if desired. The object of the invention, is achieved by providing at least one connection position having a plurality of spaced insulated openings associated with a plurality of conductors for receiving a plurality of plug contacts. Each plug contact comprises a plug element engaging a respective conductor.

The present invention provides simple means for securing the plug in its engaged or "on" position in a contact arrangement with a plurality of insulated openings with a corresponding number of plug contacts, which might, thus, be generally designed with one pole. This applies not only to those designs which, in the engaged condition of the connection plug, have no possibility of moving and are, therefore, switched only by inserting and withdrawing the plug, but also to those designs which can be switched by rotating or shifting the inserted plug between different positions. Precisely in this type of design, providing insulated mutually separated openings for receiving one or several plug contacts and defining switched-on and switched-off positions as well as providing passages within the insulation material between these openings for shifting the plug contacts insure a reliable engagement of the plug contacts in different operational positions, as well as a reliable bridging and breaking of contacts. Moreover, the mutual distances between the contact elements and, thus, the current escape path, at various plug contacts of a connection plug, can be conveniently made relatively large without substantially limiting cross-sectional dimensions of the multi-pole plug contacts.

Important further features and embodiments of the invention are described below with reference to the attached drawings. In the drawings.

The examples of embodiments show an application of the invention to conductor arrangements in the form of a flat cable with soft flexible or soft elastic insulation and wires imbedded therein, also correspondingly flexible. However, in principle, other kinds of conductor arrangements may be considered. For example, an arrangement with rigid conductors or, essentially, only plastically deformable, especially wire or rod-shape conductors may be used. The deformability of the insulation may also be widely varied. A considerable elastic deformation range of the insulating material, with definite values of the elasticity modulus, in each case, in the zone of the insulated opening for receiving the plugs, is desired in order to assure and the secure the position of the plug contact, under a prestress. It is also possible, in principle, to assign this pressing and prestress function, completely or in part, to spring-elastic plug contacts, or even to the conductors, in which case the choice of an insulating material according to other requirements is possible. The specific advantages of the invention may be realized while also taking into account suitable constructive modifications, per se known.

Figure 1:
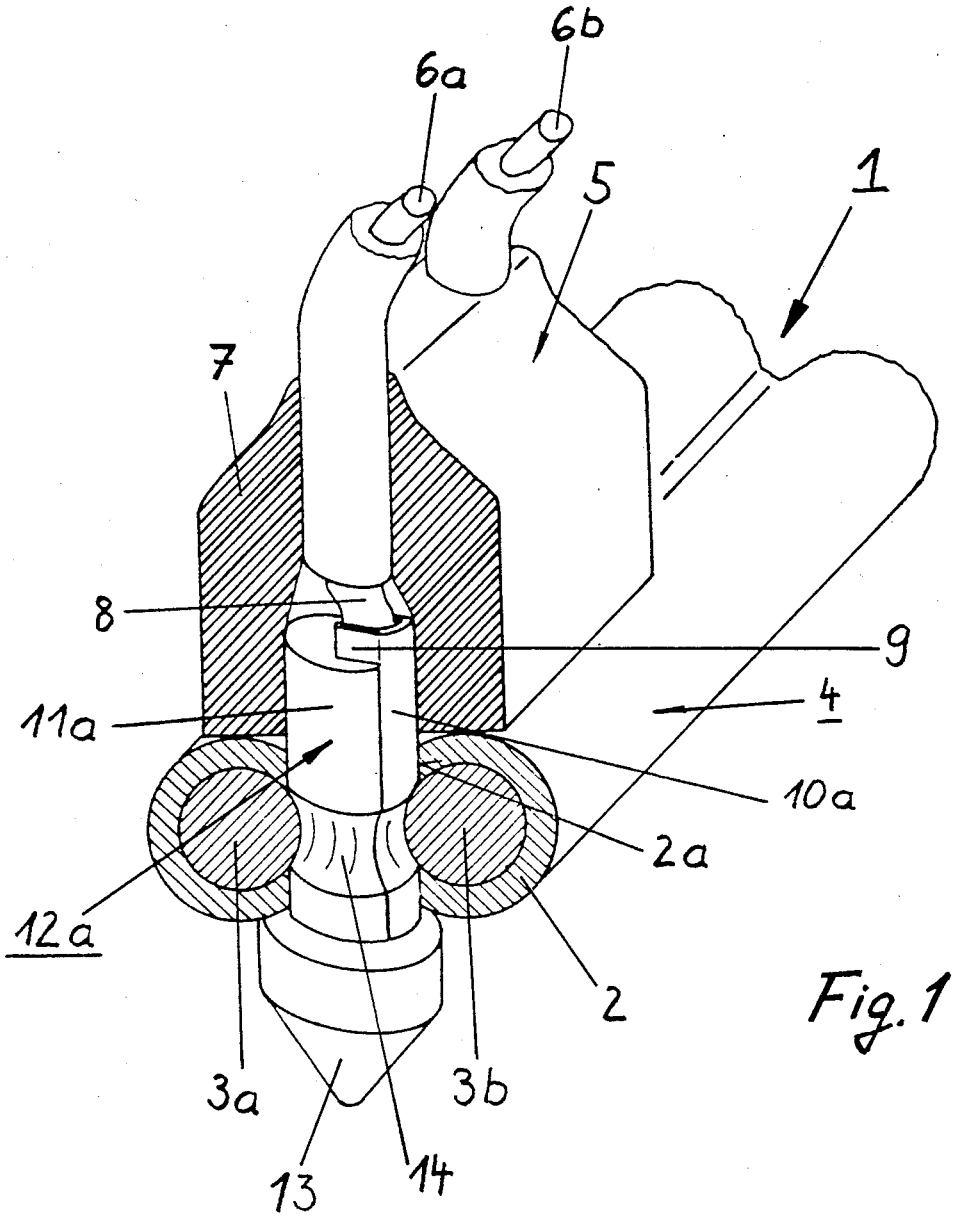
FIG. 1 is a perspective cross-sectional view of a contact arrangement comprising a two-pole connection plug and a corresponding multi-operating connection position in a flat cable.
Figure 2:
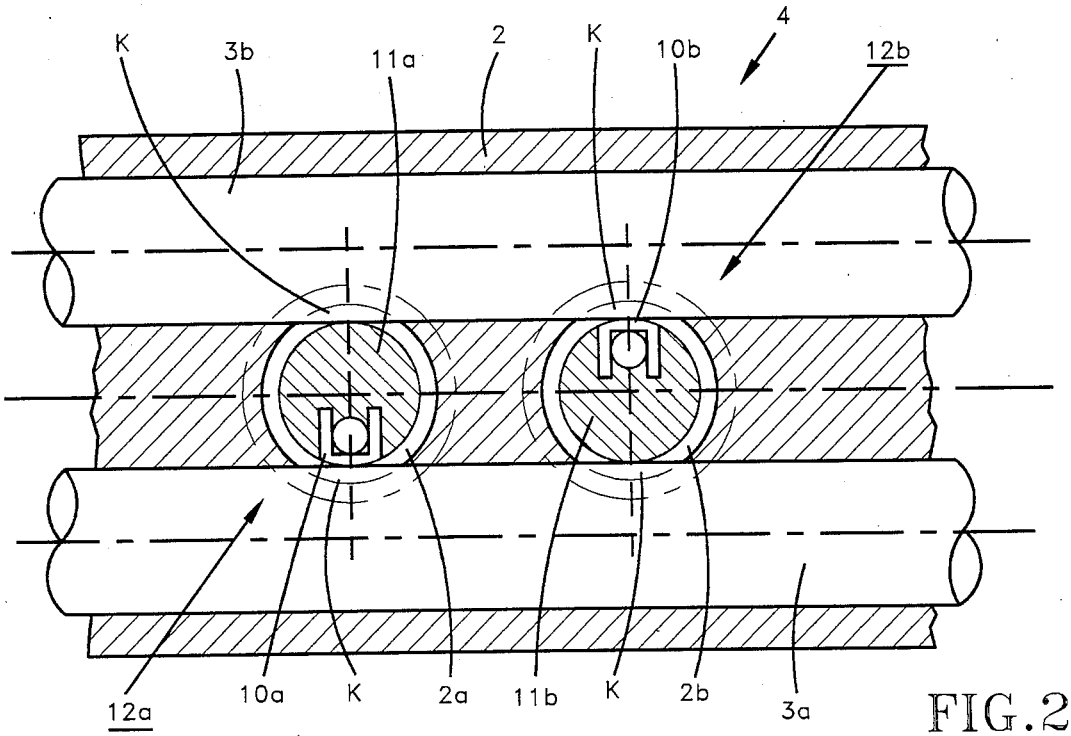
FIG. 2 is a longitudinal sectional view through the axes of the two flat cable wires of the connection position of FIG. 1 with the plug inserted into the opening.

In the embodiment of FIGS. 1 and 2, the flat cable 1 comprises an insulation 2, in which are imbedded two wires 3*a* and 3*b*, extending side-by-side. Openings 2*a* and 2*b* are formed in the zone of a connection position 4, between the two wires and extend through the insulation symmetrically relative to the longitudinal axis of the cable. At diametrically opposed end zones of contact points K, lay two bare wires.

A two-pole plug 5, received in the connection position 4 comprises two conductors 6*a* and 6*b* and an insulation body 7, within which the end sections 8 of the conductors are connected each through clamping or soldering connections 9 to respective contact elements, 10*a* and 10*b*. The latter form, in each case, together with a substantially cylindrical insulation element 11*a* and 11*b*, plug contacts 12*a* and 12*b* which, at their upper end sections, are imbedded tightly into the insulation body 7, and at their lower sections, reach the insulated openings 2*a* and *b*. At the lower ends of the plug contacts, the insulation elements 11*a*, 11*b* each form a conical head 13 the upper shoulder of which abuts against the lower side of the cable insulation and secures the plug in its engaged position. The head diameter is so dimensioned that the elastic resilience of the insulation makes possible the engagement of the outlets 2*a* and 2*b* with sufficient force and without damage to the insulation. In the lower section of the plug contact, a peripheral depression 14 is formed which is engaged by contact surfaces of the two bare wires having relatively large contacting areas in the zone of the particular contact element 10*a* or 10*b*.

As shown in FIG. 2, opposite contact and insulating elements are provided in pairs on cross-sectional circumferences of the plug contacts 12*a* and 12*b*, transverse to their conductors across to each other in relation to these conductors. In this way, it is assured that each plug contact or contact element engages only its assigned wire despite the fact that the contact points K of the two wires are not insulated within the insulated outlets. Naturally, several contact elements might be provided, side-by-side, at one plug contact, so long as the above condition for the selective contacting of wires is maintained.

Figure 3:
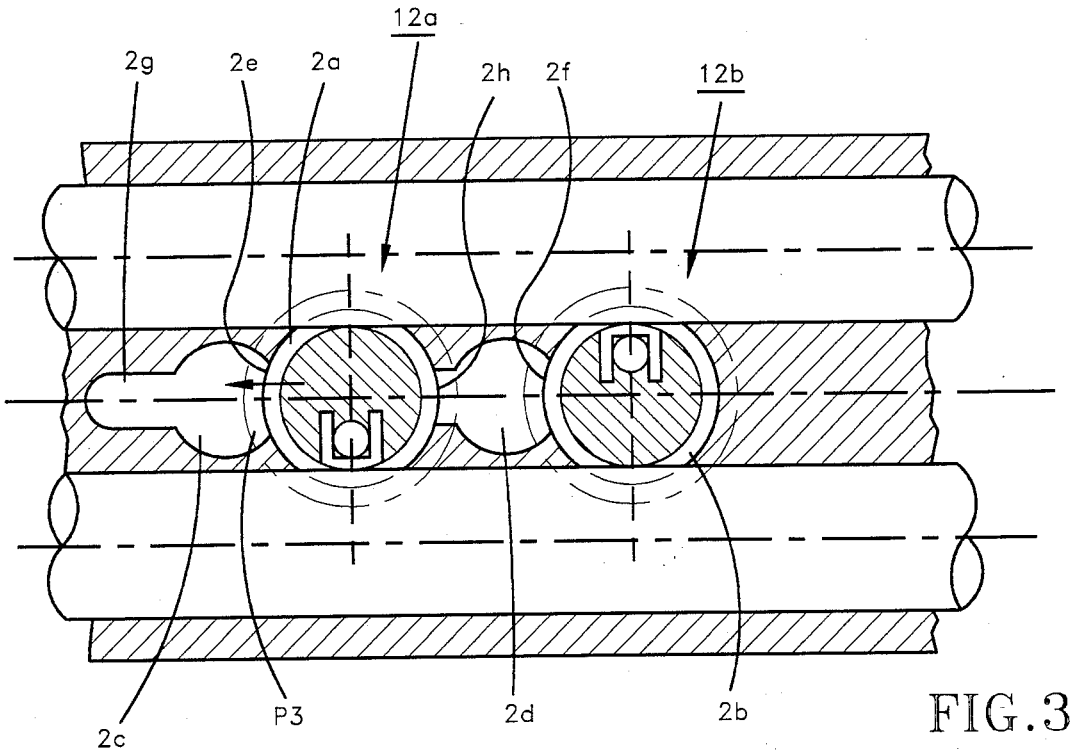
FIG. 3 is a view similar to that of FIG. 2 of a modification of the flat cable contact arrangement with a plug received in a connection position in which the contacts are able to shift.

To the extent described thus far, the contact arrangement according to FIG. 3 is similar to that of FIGS. 1 and 2. Therefore, the plug contacts and the insulation outlets for receiving them in the positions represented, are assigned the same reference numbers. But the embodiment according to FIG. 3 is also provided with additional insulated openings 2*c* and 2*d*, arranged, in each case, adjacent to the openings 2*a*, 2*b*, and connected therewith by open passage zones 2*e* and 2*f* for switching to "on" and "off" conditions. To switch from the indicated "on" or engaged condition to the "off" condition, it is only necessary to push the connection plug with its plug contacts 12*a* and 12*b* in the direction of the arrow P3 until the plug contacts rest in the insulated openings 2*c* and 2*d*, respectively. This latter are of a smaller diameter and therefore without rim side connection with the cable wires, therefore, there is no contact. An additional axial slot 2*g* of the outlet 2*c*, as well as an additional breaking point 2*h* between the opening 2*a* and 2*d* insure resilience of the insulation in the cable cross-section, so that the pushing of the plug contacts does not meet too great resistance, but on the other hand, there is retained a sufficient transverse prestress of the insulation.

Figure 4:
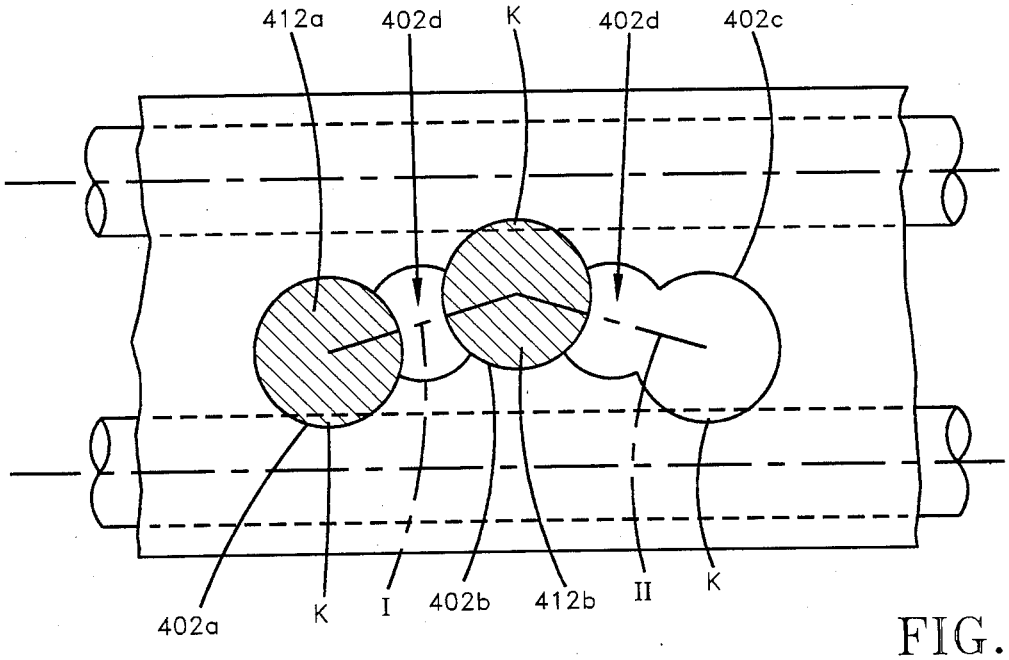
FIG. 4 is another embodiment of a flat cable contact arrangement with a multi-opening connection position in which the contacts can be switched as seen in top view in relation to the plane of wires of the flat cable.

In the embodiment of FIG. 4, there is provided a connection position with three insulated openings 402*a*, 402*b*, and 402*c* connected by passages 402*d*. A plug contact is received within the connection position. The plug contact has two contact elements 412*a* and 412*b* movable between the openings and adapted to be fixedly retained in the respective openings. A respective opening and a wire assigned to it form a connection point K whereby the contact element is connected to the wire. Due to such an arrangement, simple and cheap contact elements can be used.

This contact arrangement has an intermediate position where there is no contact between the plug contact and the conductors. The contact elements 412*a* and 412*b* move between positions I and II for engaging the conductors, and the intermediate position. The opening 402*b* is common to both positions I and II. The plug contact can perform translating or rotary movement, or both, as in the discussed embodiment. The contact plug may be a conventional contact plug with contact elements separated by insulation material. The opening position may have a relatively large central passage zone with several smaller catch openings for receiving the contact elements, the catch opening having contact points for engaging with the contact elements.

Figure 6:
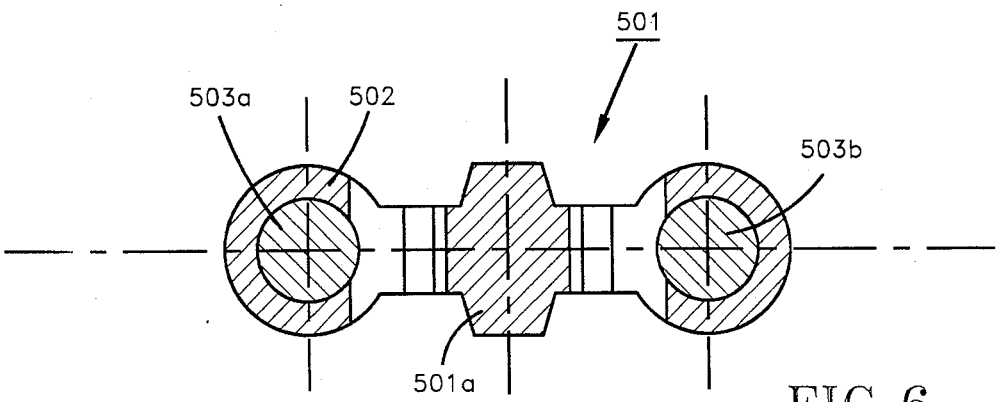
FIG. 6 is a cross-sectional view of the contact arrangement along section plane VI—VI in FIG. 5.
Figure 5:
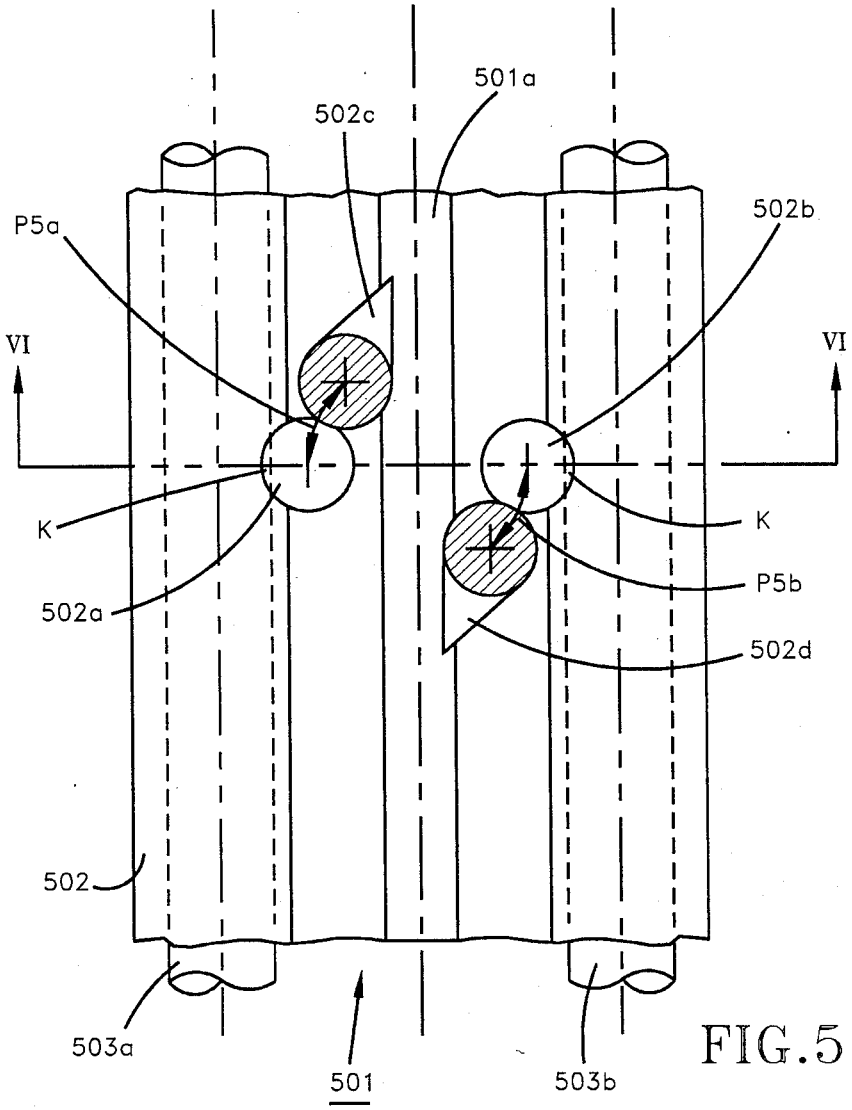
FIG. 5 is a top view according to FIG. 4 of a switching contact arrangement with a multi-opening connection position on a two-wire wide flat cable with a thickened intermediate insulation crosspiece.

In the embodiment of FIGS. 5 and 6, a wide surface cable 501 is provided with an insulation 502 and a thickened insulation intermediate crosspiece 501*a*, as well as two wires 503*a* and 503*b*. Such a design may be advantageously considered for higher operational voltages.

Here, two insulation openings mutually spaced only in the transverse direction of the cable, form with their respective wires, connection points K, so that simple, entirely conductive plug contacts can be used.

This contact arrangement, with the aid of additional insulation openings 502*c* and 502*d* overlapping the openings 502*a* and 502*b*, respectively, is also designed so that it can be switched on and off. The switching movement of the plug contacts or of the plug (not specially represented here), however, because of the selected shaping of the outline in the mutual position of the opening arrangements 502*a*/502*c* and 502*b*/502*d*, is rotary in the direction of arrows P5*a* and P5*b*, which is sometimes desirable.

Figure 7:
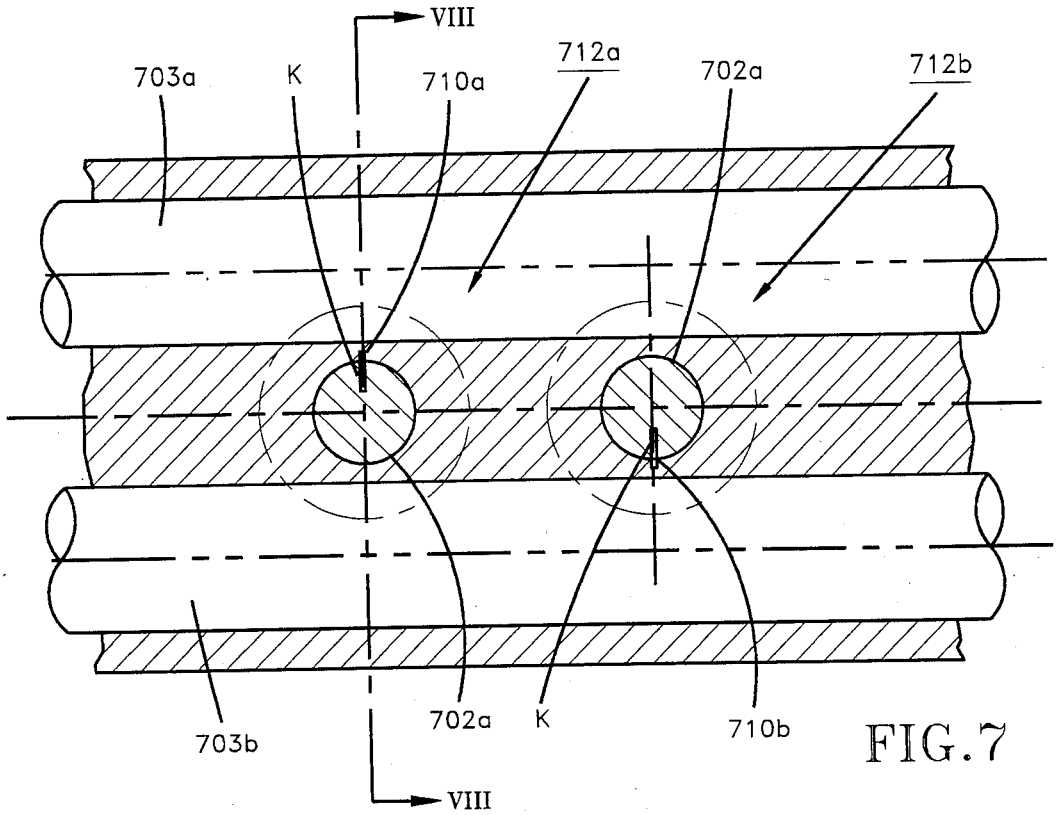
FIG. 7 is a longitudinal sectional view along lines VII—VII of FIG. 8 of a flat cable contact arrangement, which cannot be switched, with multi-opening connection position and self-cutting plug contacts inserted therein.
Figure 8:
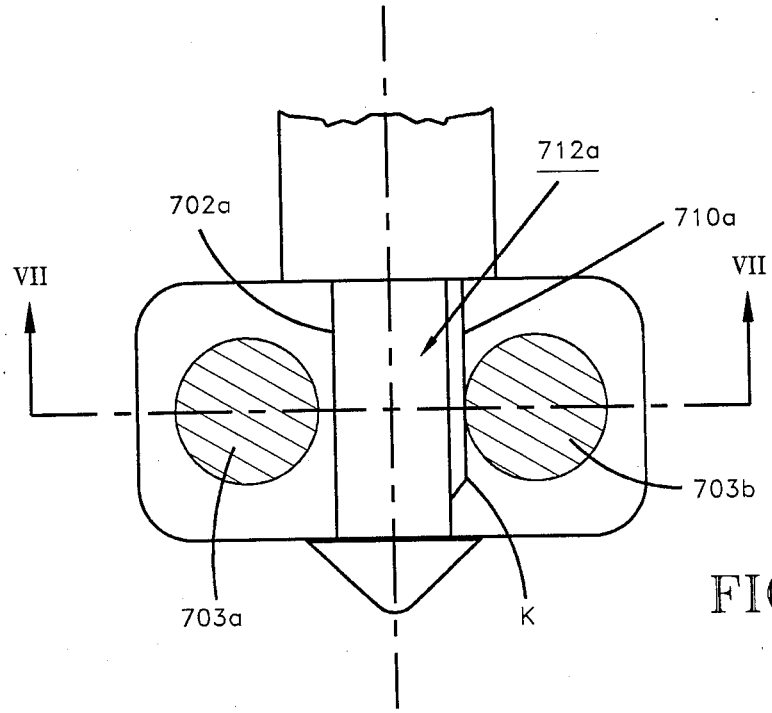
FIG. 8 is a cross-sectional view along lines VIII—VIII in FIG. 7 of the connection socket with a plug inserted therein.

In the contact arrangement according to FIGS. 7 and 8, two insulation openings 702*a* and 702*b* have circumferences spaced from the flat cable lines 703*a* and 703*b*. Two respective plug contacts 712*a* and 712*b* are each provided, on their respective opposite circumferential zones crosswise of the cable, with contact elements 710*a* and 710*b*, respectively, having knife-edge form and which extend along the plug contact section engaging with the respective insulation outlet. The diametrically opposite areas of the cross-sectional circumference of the two plug contacts associated with the contact elements 710*a*, 710*b*, are insulated or are provided with insulating elements which are complementary to the contact elements. In this way, the contact elements and insulating zones are arranged symmetriclly relative to each other with respect to the conductor arrangement, so that each contact element upon inserting of the plug contacts 712*a*, 712*b*, joined rigidly together by a plug body (not shown), into the insulated opening, can come into contact only with the cable wire 703*a* or 703*b* assigned to it. Thereby, the outer lengthwise edges of the contact elements intersect the relatively thin layer of insulation material at the narrowest point between contact plug and the wire so that the knife edges insure a secure contact.

Figure 9:
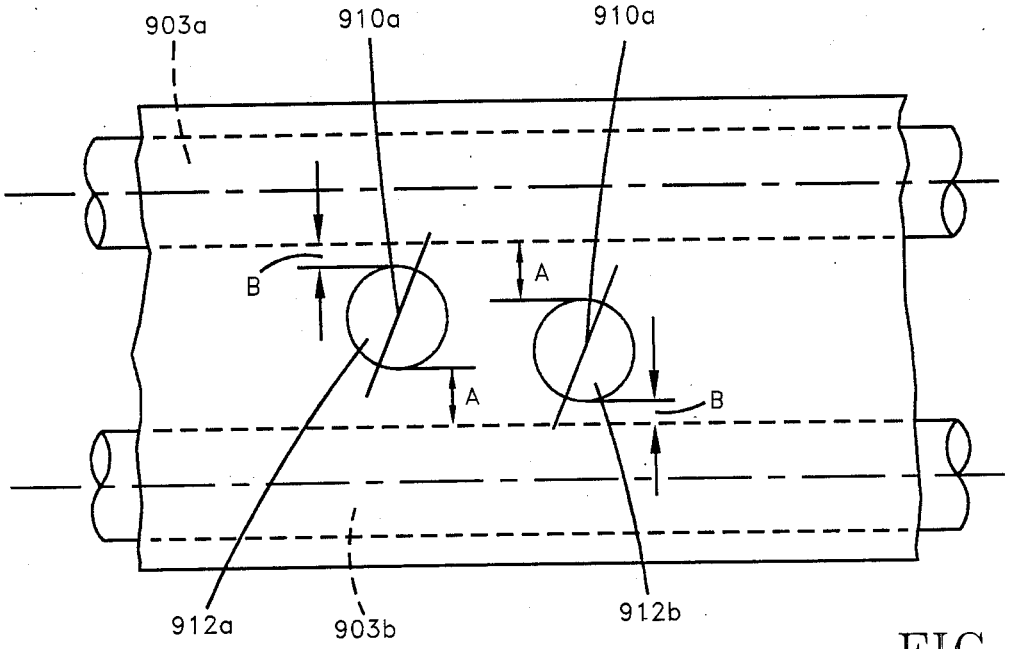
FIG. 9 is a top view of a modified flat cable contact arrangement with multi-opening connection position and self-cutting plug contacts.

In the embodiment of FIG. 9, two plug contacts 912*a* and 912*b* are provided with knife edge-shape contact elements 910*a* and 910*b* so that in each case a projecting contact knife edge is present at two diametrically opposite areas of the cross-sectional circumference of the plug contacts. Likewise, provision is made, in an advantageously simple way, that the plug contact received in an insulated opening by its contact element can only come into contact with that wire, 903*a* or 903*b*, which is associated with this insulation opening. This is attained because the two insulation openings are mutually displaced crosswise of the cable and are arranged within the inulation between the two wires, namely, with different distances A and B on both sides between plug contact circumference and the adjacent wire. The projection of the contact knife edge on the plug contact is so dimensioned that in each case only a thin layer of insulating material, according to distance B, can be passed through by the contact knife edge for effecting a contact. This embodiment is advantageously characterized by especially simple structure and by easy manufacturing of the plug contacts.

We claim:

1. An electric contact arrangement between a multistrand cable having an insulation made of an elastically yieldable material and a plurality of elongated conductor extending in side-by-side relationship and imbedded in the insulation and a plug having first and second plug contacts, said electric contact arrangement having at least one connection position arranged within the lengthwise extent of the cable and defined by first and second insulated openings arranged within the lengthwise extent of the cable and located in a space between two adjacent conductors for receiving said first and second plug contacts, respectively, each of the first and second openings intersecting at an edge zone thereof one of the two adjacent conductors to form a contact point thereat, the contact points of the first and second openings or complementary insulation zones thereof being arranged symmetrically with respect to the two adjacent conductors, each of the first and second plug contacts having a contact element for engaging the conductor intersected by respective one of the first and second openings at the contact point of the respective one opening upon insertion of the respective one of the first and second plug contacts into the respective opening.

2. An electric contact arrangement according to claim 1 wherein the outer circumference of the first opening is spaced from any one of the two adjacent conductors transverse of the longitudinal extent of the cable at distances that are inversely proportional to distances at which the outer circumference of the second opening is spaced transverse of the longituidnal extent of the cable from the anyone of the two adjacent conductors so that each of the first and second openings is separated from the two adjacent conductors transverse to the longitudinal extent of the cable by insulation layers of different thickness, and each of the first and second plug contacts is provided on the circumference of the cross-section thereof with at least one diametrically projecting two-edge contact blade which upon insertion of a respective one of first and second plug contacts into the respective one of the first and second openings, cuts through a respective insulation layer of smaller thickness to establish an electrical connection with the respective conductor.

3. An electric contact arrangement according to claim 1 wherein a third insulated opening is located in the space between the two adjacent conductors and at least one passage connecting the third opening with one of the first and second openings, and one of the first and second plug contacts is movable between the one of the first and second openings and the third opening and the other of the first and second plug contacts being movable between the other of the first and second openings and the one of the first and second openings.

4. An electric contact arrangement according to claim 3 wherein the third opening intersects and forms a contact point with the conductor which is intersected by the other of the first and second opening.

5. An electric contact arrangement according to claim 3 wherein the third opening does not form a contact point with any of the two adjacent conductors.

6. An electric contact arrangement according to claim 1 wherein each of the first and second plug contact is provided, on the circumference of its cross section, with at least one contact element and at least one insulation element, the contact and insulation elements of the first and second plug contacts being arranged, respectively, symmetrically relative to each other with respect to the two adjacent conductors.

7. An electric contact arrangement according to claim 6 wherein the circumferences of the two openings are spaced from adjacent conductors, the plug contacts are provided at opposite zones of their cross-section circumference, with at least one projecting knife edge contact element and at least one complementary insulation element, and said contact elements and insulation elements are arranged symmetrically relative to the longitudinal axis of said cable.

8. An electric contact arrangement according to claim 6 wherein said two insulated openings are spaced in the lengthwise direction of the cable, and said first and second contact points or their complementary insulation zones are arranged symmetrically relative to the longitudinal axis of said cable.

9. An electric contact arrangement according to claim 6 comprising a plurality of insulated openings joined together by a respective plurality of open passage zones, a plug contact being movable between said plurality of openings through said open passages zones, and at least one contact point being associated with a respective conductor within the circumference of at least one of these insulation openings.

10. An electric contact arrangement according to claim 9 wherein the two openings associated with respective contacts overlap each other, the contact point of the insulated opening common to both sets of openings is associated with a first conductor, and contact points of each of the two insulated openings not common to both sets of openings, are associated both with a second conductor.

11. An electric contact arrangement according to claim 9 or 10 wherein at least one opening of a set of continuously joined openings associated with one plug contact, is free of contact with a conductor and forms a turned-off position for the plug contact received in said one opening.

12. An electric contact arrangement for supplying electric current to a load from elongated conductors of a multi-strand cable, said electric contact arrangement comprising at least two spaced openings insulated from each other and located within the longitudinal extent of the cable, at least one conductor intersecting one opening forming therein a first contact point and another conductor intersecting the other opening forming therein a second contact point, and plug contact means for connecting said one and said another conductors with the load, said plug contact means comprising two plug contacts insulated from each other by elastically yieldable insulation material and received, respectfully, in said two openings, each plug contact electrically contacting only one of said first or second contact points, respectively, said openings being spaced from each other in the lengthwise direction of the cable, each plug contact having on its circumference one contact element and one insulation element, and said plug contacts being arranged symmetrically relative to the longitudinal axis of said cable.

13. An electric contact arrangement between a cable having an insulation made of an elastically yieldable material and at least two parallel spaced conductors embedded in the insulation, and a plug having two electrically isolated plug contacts, said electric contact arrangement having at least one opening formed in the insulation and located in a space between the two conductors, the cross-sections of said one opening and said two plug contacts are so shaped and the distance between the two contacts is selected such that the two contacts are inserted into the one opening by elastically deforming the insulation and are kept in the one opening between the two conductors due to elasticity of the insulation, the one opening has at least one connection position in which the plug contacts from electrical connections with respective ones of the two conductors upon being inserted into the one opening.

14. An electric contact arrangement according to claim 13 wherein the one insulation opening comprises a separate bore for each plug contact.

15. An electric contact arrangement according to claim 13 wherein the one opening has a connection-free position or another connection position, the plug contacts being brought into the connection-free position or another connection position by rotating and/or shifting the plug from the one connection position.

16. An electric contact arrangement according to claim 15 wherein the plug contacts are kept in the connection-free and another connection position due to the elasticity of the insulation.

17. An electric contact arrangement according to claim 13 wherein the one opening intersects the two conductors at least at two diametrically opposite edge zones thereof to form two contact points thereat, the plug contacts electrically contacting the two conductors at said two contact points, respectively, in said one connection position.

18. An electric contact arrangement according to claim 17 wherein the two conductors and the one opening define two pairs of respective opposite contact points, the plug contacts, in an engaged condition in the one connection position, are in contact with both contact points of the respective pairs of contact points, each of the plug contacts being provided with an insulation element so that, despite contacting both contact points of a respective pair of contact points, each plug contact electrically contacts only one of the two conductors.

19. An electrical contact arrangement of a multi-strand cable having an insulation made of an elastically yieldable material and a plurality of elongated conductors extending in a side-by-side relationship and imbedded in the insulation, and a plug having first and second plug contacts, said electric contact arrangement having at least one connection position defined by first and second insulated openings arranged within the lengthwise extent of the cable and located in a space between two adjacent conductors and for receiving said first and second plug contacts, respectively, the outer circumference of each of the first and second openings being spaced from the associated conductors so that an insulation layer exists between the outer circumference of each of the first and second openings and the associated conductors, each of the first and second plug contacts being provided on the circumference of its cross-section with at least one projecting knife-edge contact element for engaging a respective conductor at a contact point upon insertion of the first and second plug contacts into respective openings, each of said first and second plug contacts also having a complementary insulation element, the knife-edge contact element and the complemetary insulation element of the first plug contact and the knife-edge contact element and the complementary insulation element of the second plug contact being arranged symmetrically relative to each other with respect to the longitudinal axis of said cable and in such a manner that the knife-edge contact elements of the first and second plug contacts are located on opposite sides of the longitudinal axis of said cable, respectively, for engaging respective conductors.

20. An electric contact arrangement for supplying electric current to a load from elongated conductors of a multi-strand cable, said electric contact arrangement comprising at least two spaced openings insulated from each other and located within the longituidnal extent of the cable, at least one conductor extending adjacent one opening forming thereat a first contact point and another conductor extending adjacent the other opening forming thereat a second contact point, and plug contact means for connecting said one and said another conductors with the load, said plug contact means comprising two plug contacts insulated from each other by elastically yieldable insulation material and received, respectfully, in said two openings, each plug contact electrically contacting only one of said first or second contact points, respectively, said openings being spaced from each other in the lengthwise direction of the cable, each plug contact having on its circumference one contact element and one insulation element, and said plug contacts being arranged symmetriclly relative to the longitudinal axis of said cable, the outer circumference of the one opening being spaced from the one and the other conductors transverse of the longitudinal extent of the cable at smaller and larger distances, respectively, so that the one opening is separated from the one and other conductors transverse to the longitudinal extent of the cable by insulation layers of a smaller thickness and a larger thickness, respectively, and the outer circumference of the other opening being spaced from the other and the one conductors transverse of the longitudinal extent of the cable at smaller and larger distances, respectively, so that the other opening is separated from the other and one conductors transverse to the longitudinal extent of the cable by insulation layers of a smaller thickness and a larger thickness, respectively, and each plug contact element being provided on the circumference of the cross-section thereof with at least one diametrically projecting two-edged contact blade which, upon insertion of a respective plug contact into a respective opening, cuts through a respective insulation layer of the smaller thickness to establish an electrical connection with a respective conductor.

* * * * *